US008235019B2

(12) United States Patent
Davis

(10) Patent No.: US 8,235,019 B2
(45) Date of Patent: Aug. 7, 2012

(54) ENGINE HAVING CONCENTRIC CAMSHAFT WITH DIFFERENTIAL VALVE LIFT

(75) Inventor: Richard Stephen Davis, Lake Orion, MI (US)

(73) Assignee: GM Global Technology Operations LLC

( * ) Notice: Subject to any disclaimer, the term of this patent is extended or adjusted under 35 U.S.C. 154(b) by 380 days.

(21) Appl. No.: 12/616,444

(22) Filed: Nov. 11, 2009

(65) Prior Publication Data

US 2011/0107990 A1 May 12, 2011

(51) Int. Cl.
*F01L 1/04* (2006.01)

(52) U.S. Cl. ..... 123/90.6; 123/90.16; 123/90.27; 123/90.44

(58) Field of Classification Search ..... 123/90.6, 123/90.16, 90.27, 90.44
See application file for complete search history.

(56) References Cited

U.S. PATENT DOCUMENTS 3,516,394 A * 6/1970 Nichols ..... 123/90.17
7,845,075 B2 * 12/2010 Fritz et al. ..... 29/888.1

FOREIGN PATENT DOCUMENTS

DE 19855932 A1 6/2000

* cited by examiner

*Primary Examiner* — Ching Chang
(74) *Attorney, Agent, or Firm* — Harness, Dickey & Pierce, P.L.C.

(57) ABSTRACT

A camshaft assembly may include a first shaft, a second shaft, a first lobe and a second lobe. The second shaft may be coaxial with and rotatable relative to the first shaft. The first lobe may be fixed for rotation with the first shaft and adapted to open a first valve in communication with an engine combustion chamber. The first lobe may define a first valve opening region having a first angular extent. The second lobe may be fixed for rotation with the second shaft and adapted to open a second valve in communication with the engine combustion chamber. The second lobe may define a second valve opening region having a second angular extent greater than the first angular extent.

20 Claims, 8 Drawing Sheets

ENGINE HAVING CONCENTRIC CAMSHAFT WITH DIFFERENTIAL VALVE LIFT

FIELD

The present disclosure relates to engine valvetrains, and more specifically to concentric camshaft assemblies with differential valve lift.

BACKGROUND

This section provides background information related to the present disclosure which is not necessarily prior art.

Internal combustion engines may combust a mixture of air and fuel in cylinders and thereby produce drive torque. Air and fuel flow into and out of the cylinders may be controlled by a valvetrain. The valvetrain may include a camshaft that actuates intake and exhaust valves and thereby controls the timing and amount of air and fuel entering the cylinders and exhaust gases leaving the cylinders.

SUMMARY

A camshaft assembly may include a first shaft, a second shaft, a first lobe and a second lobe. The second shaft may be coaxial with and rotatable relative to the first shaft. The first lobe may be fixed for rotation with the first shaft and adapted to open a first valve in communication with an engine combustion chamber. The first lobe may define a first valve opening region having a first angular extent. The second lobe may be fixed for rotation with the second shaft and adapted to open a second valve in communication with the engine combustion chamber. The second lobe may define a second valve opening region having a second angular extent greater than the first angular extent.

An engine assembly may include an engine structure, a first valve, a second valve, a first valve lift assembly, a second valve lift assembly and a camshaft assembly. The engine structure may define a combustion chamber and first and second ports in communication with the combustion chamber. The first valve may be supported by the engine structure and may selectively open and close the first port. The second valve may be supported by the engine structure and may selectively open and close the second port. The first valve lift assembly may be engaged with the first valve and the second valve lift assembly may be engaged with the second valve. The camshaft assembly may be rotationally supported by the engine structure and may include a first shaft, a second shaft, a first lobe and a second lobe. The second shaft may be coaxial with and rotatable relative to the first shaft. The first lobe may be fixed for rotation with the first shaft and engaged with the first valve lift mechanism. The first lobe may define a first valve opening region having a first angular extent. The second lobe may be fixed for rotation with the second shaft and engaged with the second valve lift mechanism. The second lobe may define a second valve opening region having a second angular extent greater than the first angular extent.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
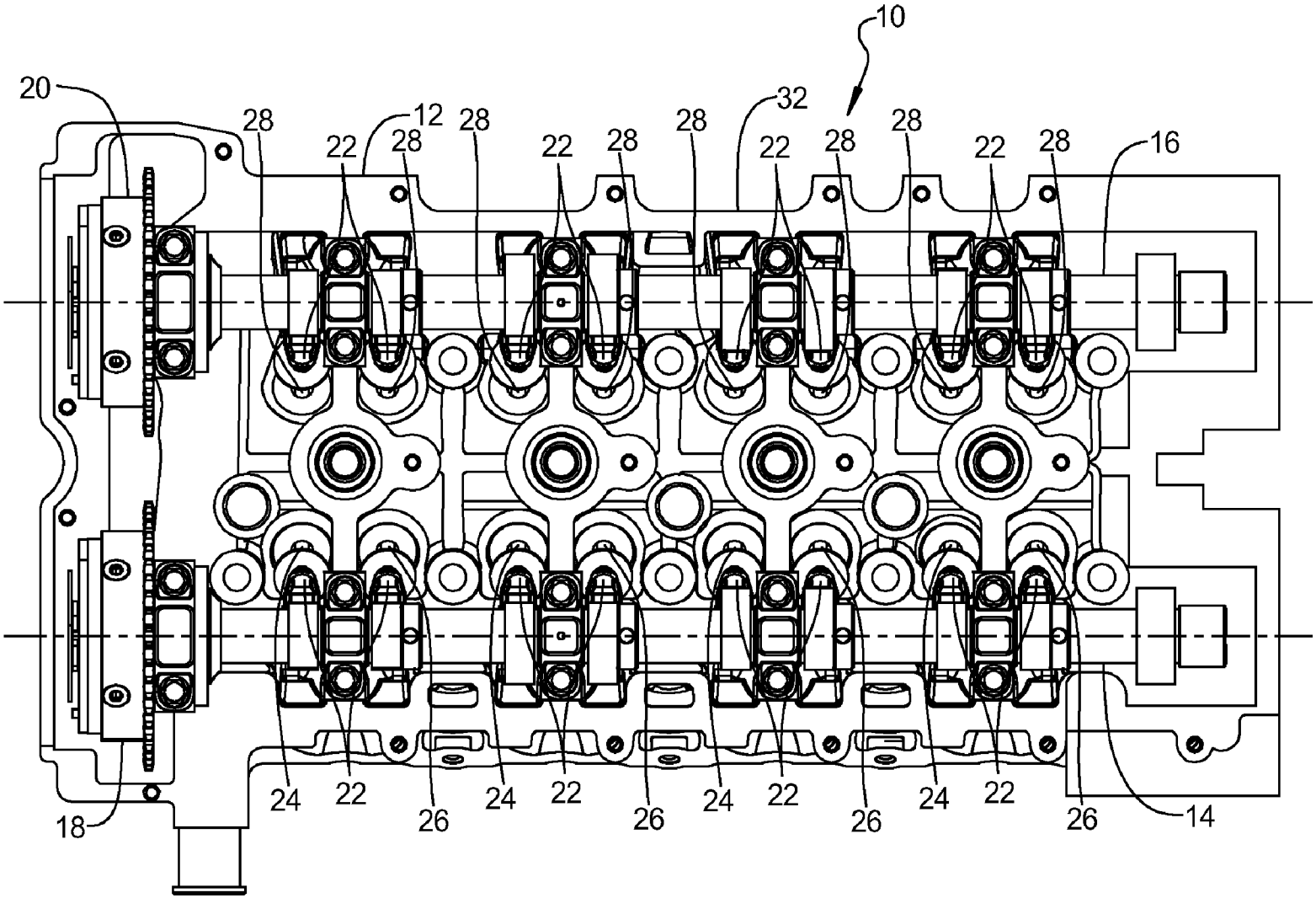
FIG. 1 is a plan view of an engine assembly according to the present disclosure.
Figure 2:
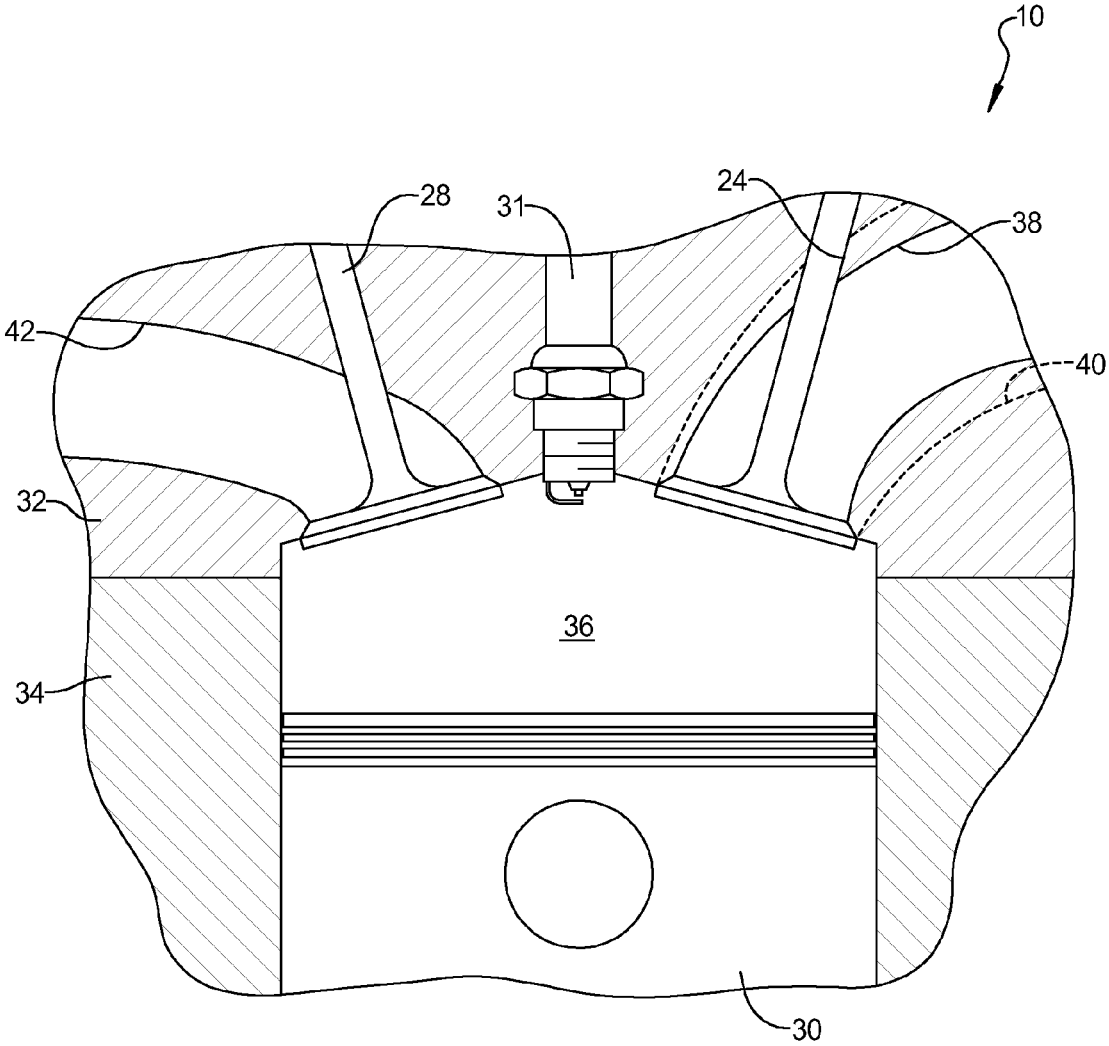
FIG. 2 is a schematic section view of the engine assembly of FIG. 1.
Figure 3:
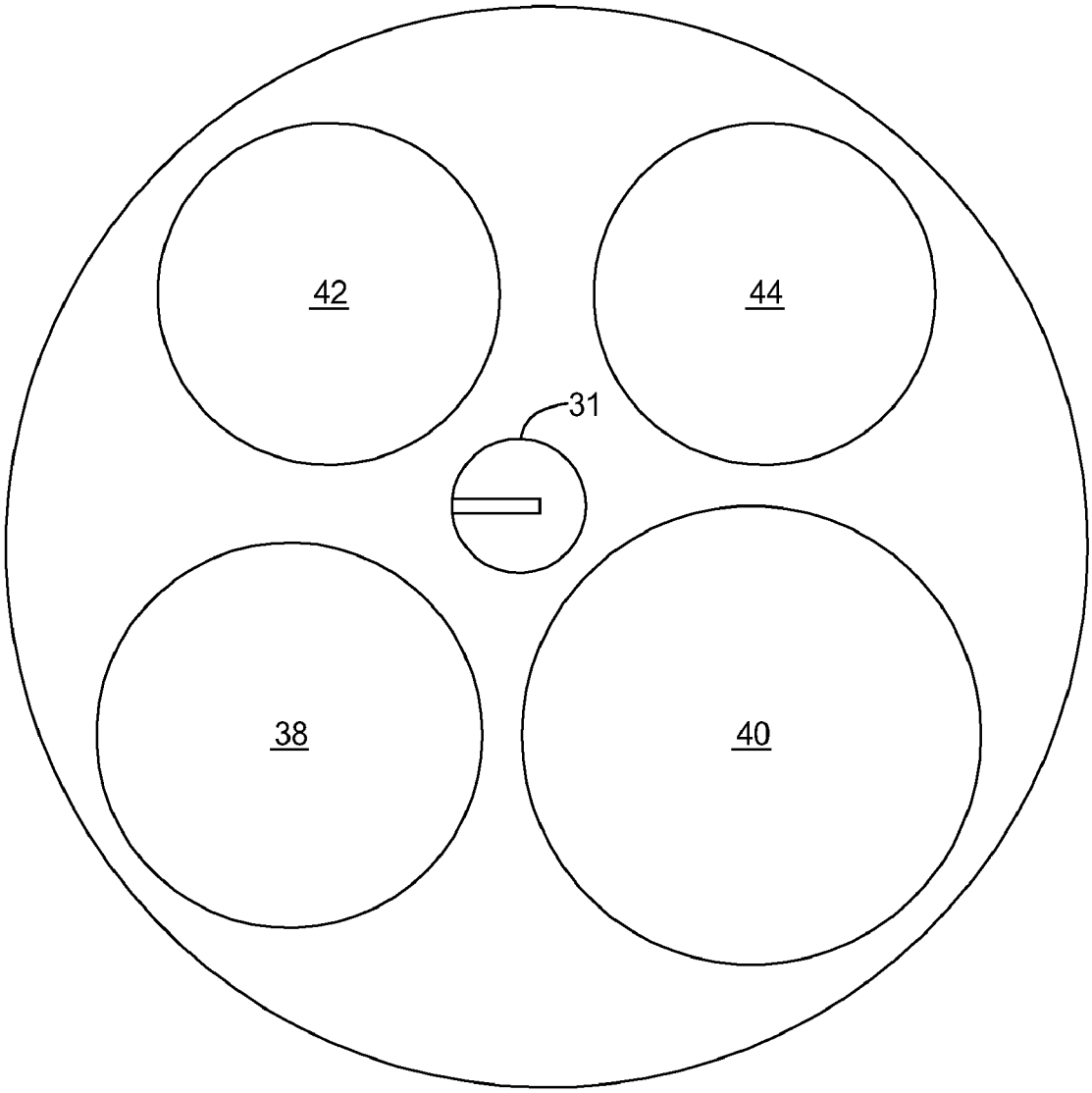
FIG. 3 is a schematic illustration of intake and exhaust ports of the engine assembly of FIG. 1.

With reference to FIGS. 1-3, an engine assembly 10 is illustrated. The engine assembly 10 may include an engine structure 12, intake and exhaust camshaft assemblies 14, 16 rotationally supported on the engine structure 12, intake and exhaust cam phasers 18, 20, valve lift assemblies 22, first and second intake valves 24, 26, exhaust valves 28, pistons 30, and spark plugs 31. In the present non-limiting example, the engine assembly 10 is shown as a dual overhead camshaft engine with the engine structure 12 including a cylinder head 32 rotationally supporting the intake and exhaust camshaft assemblies 14, 16. The engine structure 12 may additionally include an engine block 34 cooperating with the cylinder head 32 and the pistons 30 to define combustion chambers 36 (FIG. 2).

As seen in FIGS. 2 and 3, the cylinder head 32 may define first and second intake ports 38, 40 and first and second exhaust ports 42, 44 for each combustion chamber 36. The second intake port 40 may have a greater diameter, and therefore a greater cross-sectional area than the first intake port 38. By way of non-limiting example, the second intake port 40 may have a cross-sectional area ($A_{P2}$) that is at least five percent greater than the cross-sectional area ($A_{P1}$) of the first intake port 38, and more specifically between ten and thirty percent greater than the cross-sectional area ($A_{P1}$). As a result, the second intake port 40 may provide at least ten percent, and more specifically between twenty and forty percent more flow capacity than the first intake port 38.

The first intake valves 24 may open and close the first intake ports 38 and the second intake valves 26 may open and close the second intake ports 40. Therefore, the second intake valves 26 may be larger than the first intake valves 24. By way of non-limiting example, the second intake valve 26 may have a cross-sectional area ($A_{V2}$) at least ten percent greater than the cross-sectional area ($A_{V1}$) of the first intake valve 24 and the second intake valve 26 may have diameter ($D_{V2}$) at least five percent greater than the diameter ($D_{V1}$) of first intake valve 24. More specifically, the area ($A_{V2}$) may be between twenty and forty percent greater than the area ($A_{V1}$) and the diameter ($D_{V2}$) may be between ten and twenty percent greater than the diameter ($D_{V1}$).

Figure 4:
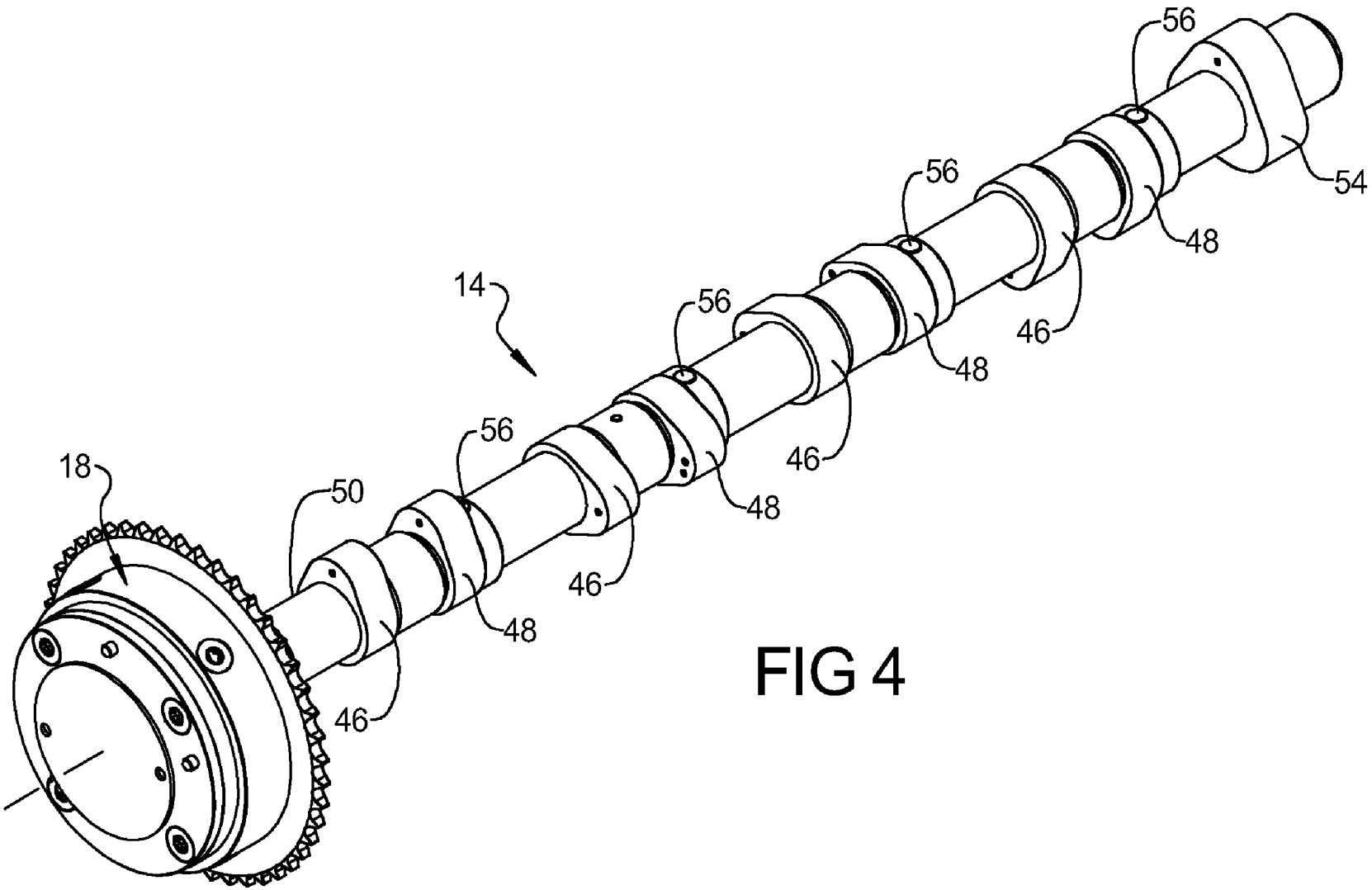
FIG. 4 is a perspective view of the intake cam phaser and intake camshaft assembly shown in FIG. 1.
Figure 5:
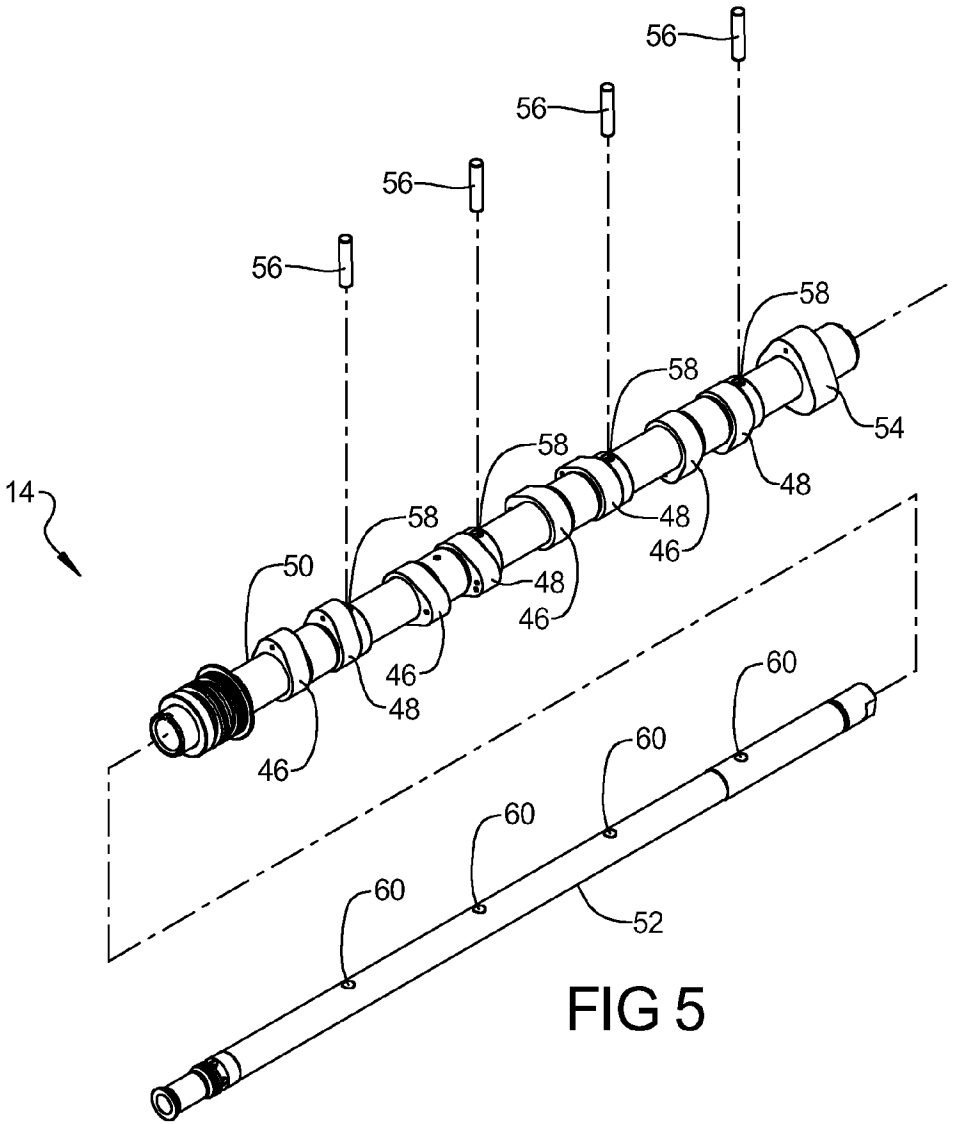
FIG. 5 is an exploded perspective view of the intake camshaft assembly shown in FIG. 1.

As seen in FIGS. 4 and 5, the intake camshaft assembly 14 may include first and second intake lobes 46, 48, first and second shafts 50, 52, and a fuel pump drive lobe 54. However, it is understood that the present disclosure applies equally to camshaft assemblies that do not include a fuel pump drive lobe. The first shaft 50 may be rotationally supported by the engine structure 12 and the second shaft 52 may be rotationally supported within the first shaft 50. The first intake lobes 46 may be located on and fixed for rotation with the first shaft 50. The second intake lobes 48 may be rotationally supported on the first shaft 50 and fixed for rotation with the second shaft 52. By way of non-limiting example, the second intake lobes 48 may be coupled to the second shaft 52 by pins 56 extending through apertures 58 in the second intake lobes 48 and apertures 60 in the second shaft 52.

Figure 7:
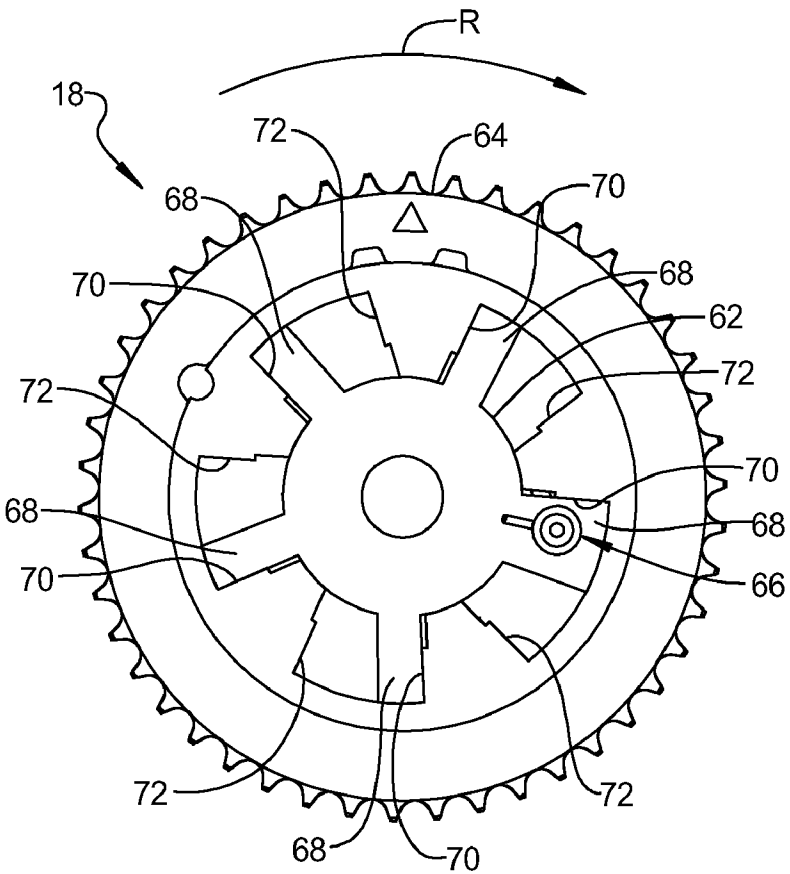
FIG. 7 is a schematic illustration of the intake cam phaser of FIG. 1 in a retarded position.
Figure 6:
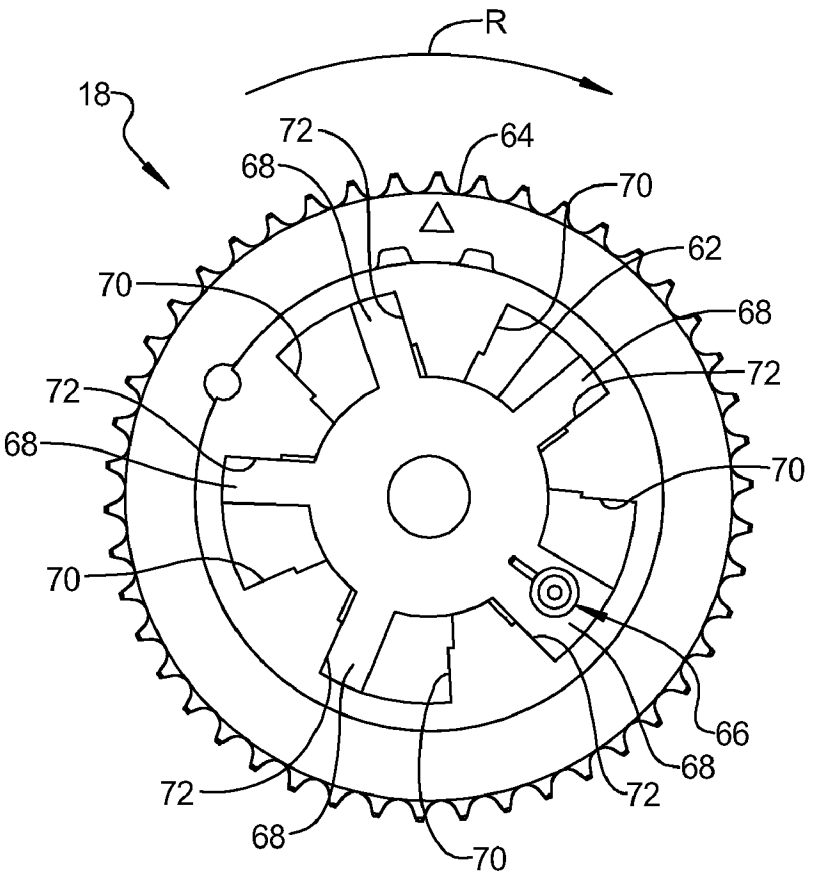
FIG. 6 is a schematic illustration of the intake cam phaser of FIG. 1 in an advanced position.

As seen in FIGS. 6 and 7, the intake cam phaser 18 may include a rotor 62, a stator 64 and a lock mechanism 66. The stator 64 may be rotationally driven by an engine crankshaft (not shown) and the rotor 62 may be rotationally supported within the stator 64. The rotor 62 may include radially extending vanes 68 cooperating with the stator 64 to define hydraulic advance and retard chambers 70, 72 in communication with pressurized fluid, such as oil.

The first shaft 50 (and therefore first intake lobes 46) may be fixed for rotation with the stator 64 and the second shaft 52 (and therefore second intake lobes 48) may be fixed for rotation with the rotor 62. The rotor 62 may be displaced from an advanced position (FIG. 6) to a retarded position (FIG. 7) to vary the opening timing of the second intake valves 26. The advanced position may correspond to a fully advanced position and the retarded position may correspond to a fully retarded position. While illustrated as a hydraulically actuated vane phaser, it is understood that the present disclosure is not limited to such arrangements. Further, while FIGS. 6 and 7 illustrate the intake cam phaser 18 in fully advanced and fully retarded positions, the intake cam phaser 18 may additionally provide an intermediate park position. By way of non-limiting example, the intermediate park position may include the locking mechanism 66 securing the rotor 62 between the advanced and retarded positions.

Figure 9:
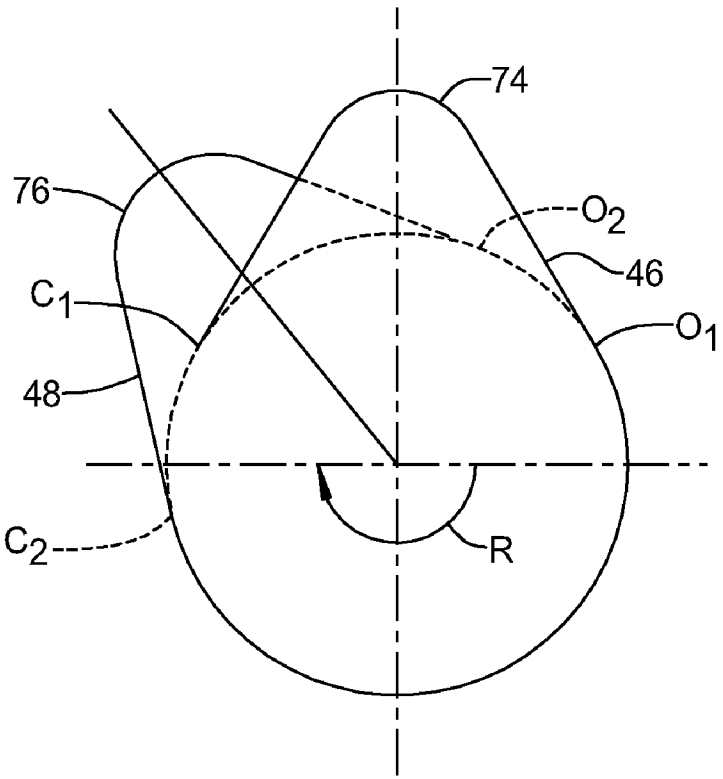
FIG. 9 is a schematic illustration of the intake cam lobe of FIG. 8 in a retarded position according to the present disclosure.
Figure 8:
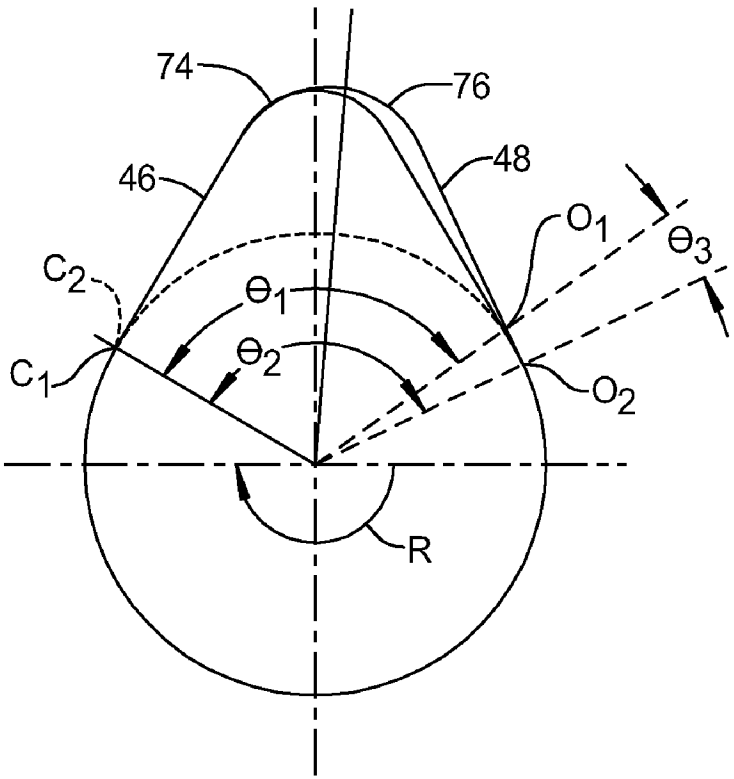
FIG. 8 is a schematic illustration of an intake cam lobe in an advanced position according to the present disclosure.

The first and second intake lobes 46, 48 are illustrated in FIGS. 8 and 9. The first intake lobe 46 may define a first valve opening region 74 having first angular extent ($\theta_1$) between a first starting (opening) point ($O_1$) and a first ending (closing) point ($C_1$). The second intake lobe 48 may define a second valve opening region 76 having a second angular extent ($\theta_2$) between a second starting (opening) point ($O_2$) and a second ending (closing) point ($C_2$). The second angular extent ($\theta_2$) may be greater than the first angular extent ($\theta_1$). By way of non-limiting example, the second angular extent ($\theta_2$) may be at least five percent greater than the first angular extent ($\theta_1$), and more specifically between ten and twenty-five percent greater than the first angular extent ($\theta_1$). Therefore, the second angular extent ($\theta_2$) may be at least five degrees greater than the first angular extent ($\theta_1$), and more specifically between ten and twenty-five degrees greater than the first angular extent ($\theta_1$).

The intake cam phaser 18 may displace the second intake lobes 48 from a first (advanced) position (FIG. 8) to a second (retarded) position (FIG. 9). In the advanced position, the first and second starting points ($O_1$, $O_2$) may be rotationally offset from one another and the first and second ending points ($C_1$, $C_2$) may be within five degrees of one another. More specifically, the first and second ending points ($C_1$, $C_2$) may be rotationally aligned with one another. By way of non-limiting example, the second starting point ($O_2$) may be located ahead of the first starting point ($O_1$) in a rotational direction (R) of the first and second intake lobes 46, 48 by an angle ($\theta_3$). The offset angle ($\theta_3$) may be at least five degrees and more specifically between ten and twenty-five degrees.

In the retarded position, the first and second starting points ($O_1$, $O_2$) may be rotationally offset from one another and the first and second ending points ($C_1$, $C_2$) may also be rotationally offset from one another. More specifically, the second starting point ($O_2$) may be located behind the first starting point ($O_1$) in the rotational direction (R). The second ending point ($C_2$) may also be located behind the first ending point ($C_1$) in the rotational direction (R). In the arrangement where the intake cam phaser 18 provides an intermediate park position, the locking mechanism 66 may secure the rotor 62 in a position where the first and second starting points ($O_1$, $O_2$) are rotationally aligned with one another.

Figure 10:
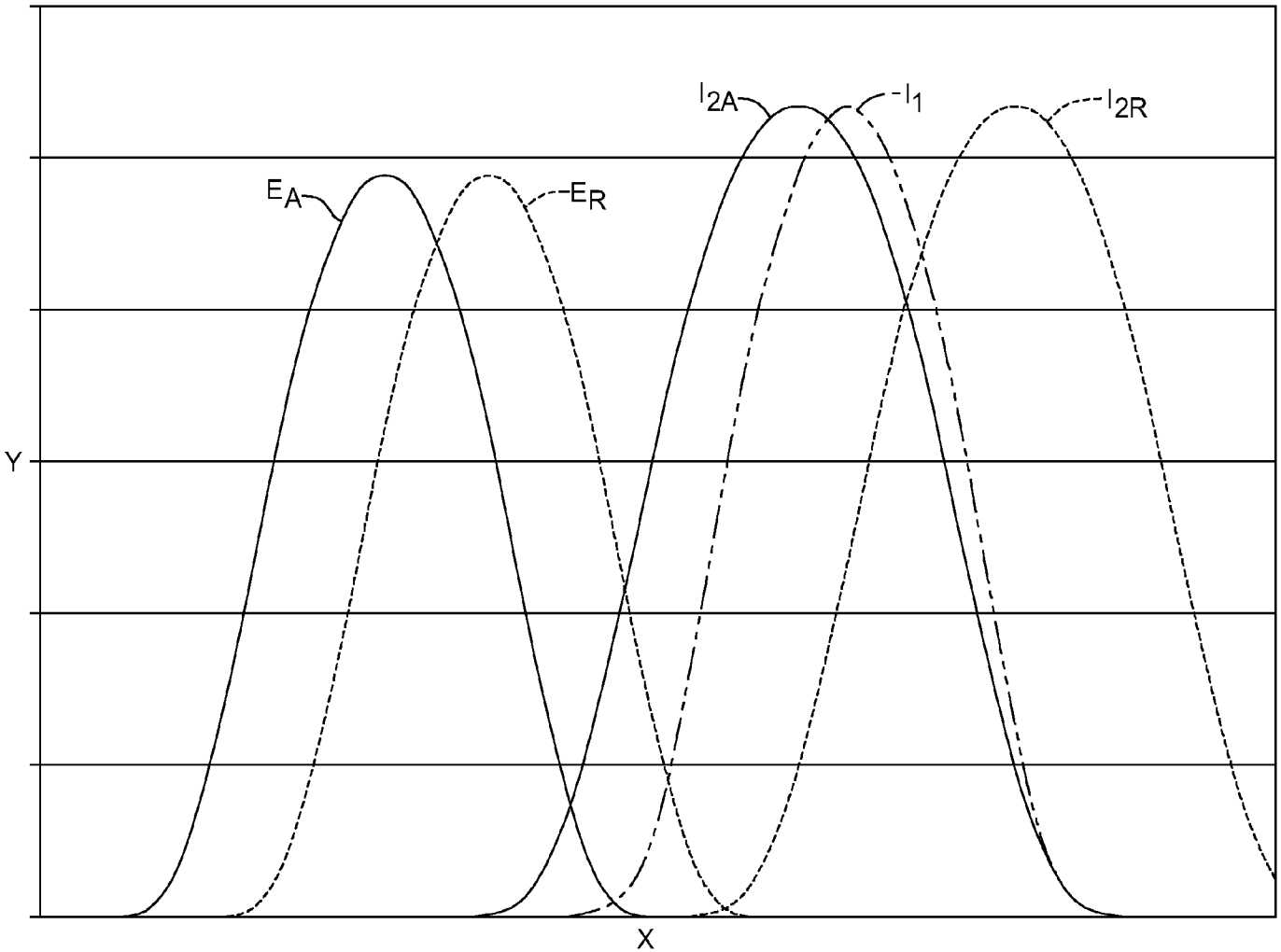
FIG. 10 is a graphical illustration of valve opening profiles according to the present disclosure.

FIG. 10 illustrates the displacement of the second intake valves 26 relative to the first intake valves 24 and relative to the exhaust valves 28 during operation. In the graph shown in FIG. 10, the x-axis represents the rotational angle of the intake and exhaust camshaft assemblies 14, 16 and the y-axis represents valve lift. The curve ($E_A$) represents the exhaust camshaft assembly 16 advanced and the curve ($E_R$) represents the exhaust camshaft assembly 16 retarded. The curve ($I_1$) represents the first (fixed) intake lobe 46, the curve ($I_{2A}$) represents the second (phased) intake lobe 48 advanced and the curve ($I_{2R}$) represents the second (phased) intake lobe 48 retarded. The advanced and retarded positions of the exhaust camshaft assembly 16 and the second (phased) intake lobe 48 may correspond to fully advanced and fully retarded positions, respectively.

As illustrated in FIG. 10, when the second intake lobe 48 is in the advanced position, the opening of the second intake valve 26 occurs before the opening of the first intake valve 24 and the closing of the second intake valve 26 is aligned with the closing of the first intake valve 24. When the second intake lobe 48 is in the retarded position, the opening of the second intake valve 26 occurs after the opening of the first intake valve 24 and closing of the second intake valve 26 occurs after the closing of the first intake valve 24. Also, as seen in FIG. 10, varying the opening and closing timing of the second intake valves 26 and the exhaust valves 28 may be used to vary valve overlap conditions. The present disclosure provides for greater variability of valve timing to realize benefits at different engine operating conditions.

By way of non-limiting example, the second intake lobes 48 may be in the first (advanced) position during low engine speed wide open throttle (WOT) conditions to optimize volumetric efficiency and torque. The second intake lobes 48 may also be in the first (advanced) position during ambient cold start conditions to increase the level of overlap between the opening of the second intake valves 26 and the exhaust valves 28. The increased overlap may generally provide for reduced hydrocarbon (HC) emission from the engine assembly 10. The second intake lobes 48 may be in the second (retarded) position during part-load engine conditions to provide delayed closing of the second intake valves 26 for reducing engine pumping loss and improving fuel economy.

The second intake lobes 48 may be in an intermediate position (between advanced and retarded) during mid and high speed WOT operating conditions to optimize the second intake valve 26 closing timing for improved volumetric efficiency and increased torque and power. The second intake lobes 48 may additionally be in the intermediate position during light load conditions, such as idle, to provide reduced overlap between the second intake valves 26 and the exhaust valves 28 and moderate the effective compression ratio to optimize light load combustion stability.

What is claimed is:

1. A camshaft assembly comprising:

a first shaft;

a second shaft coaxial with and rotatable relative to the first shaft;

a first intake lobe fixed for rotation with the first shaft and adapted to open a first intake valve in communication with an engine combustion chamber via a first valve lift assembly, the first intake lobe defining a first valve opening region having a first angular extent; and a second intake lobe fixed for rotation with the second shaft and adapted to open a second intake valve in communication with the engine combustion chamber via a second valve lift assembly, the second intake lobe defining a second valve opening region having a second angular extent greater than the first angular extent.

2. The camshaft assembly of claim 1, wherein the first intake lobe includes a first starting point and a first ending point defining the first angular extent and the second intake lobe includes a second starting point and a second ending point defining the second angular extent, the second starting point being located at least 5 degrees from the first starting point in a rotational direction of the camshaft assembly when the second intake lobe is in a first position.

3. The camshaft assembly of claim 2, wherein the second intake lobe is rotatable in a rotational direction opposite the rotational direction of the camshaft assembly from the first position to a second position.

4. The camshaft assembly of claim 3, wherein the first and second ending points are within 5 degrees of one another when the second lobe is in the first position.

5. The camshaft assembly of claim 3, wherein the first starting point is located past the second starting point in the rotational direction of the camshaft assembly when the second intake lobe is in the second position.

6. The camshaft assembly of claim 1, wherein the second angular extent is at least 5 percent greater than the first angular extent.

7. The camshaft assembly of claim 1, wherein the second angular extent is at least 5 degrees greater than the first angular extent.

8. The camshaft assembly of claim 1, wherein the second shaft is rotationally supported within the first shaft.

9. The camshaft assembly of claim 1, wherein the first and second intake lobes provide at least a portion of the opening of the first intake valve occurring at the same time as the opening of the second intake valve.

10. An engine assembly comprising:

an engine structure defining a combustion chamber and first and second intake ports in communication with the combustion chamber;

a first intake valve supported by the engine structure and selectively opening and closing the first intake port;

a second intake valve supported by the engine structure and selectively opening and closing the second intake port;

a first valve lift assembly engaged with the first intake valve;

a second valve lift assembly engaged with the second intake valve;

a camshaft assembly rotationally supported by the engine structure and including:

a first shaft;

a second shaft coaxial with and rotatable relative to the first shaft;

a first intake lobe fixed for rotation with the first shaft and engaged with the first valve lift assembly, the first intake lobe defining a first valve opening region having a first angular extent; and a second intake lobe fixed for rotation with the second shaft and engaged with the second valve lift assembly, the second intake lobe defining a second valve opening region having a second angular extent greater than the first angular extent.

11. The engine assembly of claim 10, wherein the first intake lobe includes a first starting point and a first ending point defining the first angular extent and the second intake lobe includes a second starting point and a second ending point defining the second angular extent, the second starting point being located at least 5 degrees from the first starting point in a rotational direction of the camshaft assembly when the second intake lobe is in a first position.

12. The engine assembly of claim 11, wherein the second intake lobe is rotatable in a rotational direction opposite the rotational direction of the camshaft assembly from the first position to a second position.

13. The engine assembly of claim 12, wherein the first and second ending points are within 5 degrees of one another when the second intake lobe is in the first position.

14. The engine assembly of claim 12, wherein the first starting point is located past the second starting point in the rotational direction of the camshaft assembly when the second lobe is in the second position.

15. The engine assembly of claim 10, wherein the second angular extent is at least 5 percent greater than the first angular extent.

16. The engine assembly of claim 10, wherein the second intake valve has a greater cross-sectional area than the first intake valve.

17. The engine assembly of claim 16, wherein the cross-sectional area of the second intake valve is at least 10 percent greater than the cross-sectional area of the first intake valve.

18. The engine assembly of claim 10, further comprising a cam phaser having a first member rotationally driven by a crankshaft and a second member rotatable relative to the first member, the first shaft fixed for rotation with the first member and the second shaft fixed for rotation with the second member.

19. The engine assembly of claim 18, wherein the second shaft is rotationally supported within the first shaft.

20. The engine assembly of claim 10, wherein at least a portion of the opening of the first intake valve occurs at the same time as the opening of the second intake valve.

* * * * *